US008375478B2

(12) United States Patent
Luo

(10) Patent No.: US 8,375,478 B2
(45) Date of Patent: Feb. 19, 2013

(54) WALK-IN BATHTUB WITH WATER-PROOF DOOR AND SEALING MECHANISM

(75) Inventor: Zhi Gang Luo, Guangzhou (CN)

(73) Assignee: 5 Star Steam Rooms L.L.C., Le Mars, IA (US)

( * ) Notice: Subject to any disclaimer, the term of this patent is extended or adjusted under 35 U.S.C. 154(b) by 315 days.

(21) Appl. No.: 12/409,966

(22) Filed: Mar. 24, 2009

(65) Prior Publication Data

US 2010/0156120 A1 Jun. 24, 2010

(51) Int. Cl.
*A47K 3/02* (2006.01)

(52) U.S. Cl. ..... 4/556; 4/555; 4/557; 292/36; 292/139

(58) Field of Classification Search ..... 4/555, 556, 4/557, 584, 541.1, 538, 607; 292/139, 145, 292/137, 138, 32, 36, 48, 26, 82, 123, 97, 292/158, 167, 186, 223, 196, DIG. 30, DIG. 41
See application file for complete search history.

(56) References Cited

U.S. PATENT DOCUMENTS

| | | | | | |
|---|---|---|---|---|---|
| 313,876 | A | * | 3/1885 | McArthur | 49/318 |
| 315,232 | A | * | 4/1885 | Brintnall | 292/335 |
| 1,021,740 | A | * | 3/1912 | Leighton | 292/36 |
| 1,197,612 | A | * | 9/1916 | Ditlevson | 292/36 |
| 1,207,116 | A | * | 12/1916 | Winner | 292/139 |
| 1,238,042 | A | * | 8/1917 | Moore | 292/139 |
| 1,813,093 | A | * | 7/1931 | Smith | 292/139 |
| 2,197,508 | A | * | 4/1940 | Pee | 292/352 |
| 2,456,275 | A | * | 12/1948 | Harris | 4/556 |
| 2,570,053 | A | * | 10/1951 | Fowler et al. | 4/556 |
| 2,650,388 | A | * | 9/1953 | White | 16/230 |
| 2,721,750 | A | * | 10/1955 | Rudis et al. | 292/139 |
| 2,752,186 | A | * | 6/1956 | Morrison | 292/139 |
| 2,977,604 | A | * | 4/1961 | Miller | 4/577.1 |
| 3,066,316 | A | * | 12/1962 | Russell | 4/556 |
| 3,341,239 | A | * | 9/1967 | Wheeler | 292/139 |
| 3,371,354 | A | | 3/1968 | Hayslett | |
| 3,863,275 | A | | 2/1975 | Brendgord | |
| 4,099,751 | A | * | 7/1978 | Poe et al. | 292/139 |
| 4,118,810 | A | | 10/1978 | Brickhouse | |
| 4,360,935 | A | | 11/1982 | Barrett, Sr. | |

(Continued)

FOREIGN PATENT DOCUMENTS

| | | | |
|---|---|---|---|
| CN | 200980615 | Y | 12/2006 |
| EP | 457093 | A1 * | 11/1991 |

(Continued)

OTHER PUBLICATIONS

Search Report for co-pending PCT/US2009/041886 listing relevant art cited by the International Searching Authority.

*Primary Examiner* — Robert Canfield
*Assistant Examiner* — Babajide Demuren
(74) *Attorney, Agent, or Firm* — McKee, Voorhees & Sease, P.L.C.

(57) ABSTRACT

A walk-in bathtub has an outward swinging door mounted on a door jam. The door is provided with a latching mechanism that includes an extendible latching pin for receipt within a latch receiver in the door jam. The latching pin has a contoured face for guiding the latching pin into the latch receiver, and for drawing the door close to the door jam to compress a gasket provided between the door and the door jam. A push button lock selectively locks the latching mechanism in the latched position.

18 Claims, 10 Drawing Sheets

U.S. PATENT DOCUMENTS

| | | | | |
|---|---|---|---|---|
| 4,542,545 | A | 9/1985 | Johnson | |
| D285,346 | S * | 8/1986 | Sween | D24/204 |
| 4,796,312 | A | 1/1989 | Corlew | |
| 4,802,247 | A * | 2/1989 | Leichle et al. | 4/556 |
| 4,911,485 | A * | 3/1990 | Wasilewski | 292/139 |
| 4,953,241 | A | 9/1990 | Williams | |
| 5,023,965 | A * | 6/1991 | Reichel | 4/607 |
| 5,184,358 | A * | 2/1993 | Gruidel et al. | 4/555 |
| 5,220,696 | A * | 6/1993 | Dannenberg et al. | 4/556 |
| 5,333,920 | A * | 8/1994 | de Rover | 292/48 |
| 5,688,000 | A * | 11/1997 | Dolman | 292/34 |
| 6,659,517 | B1 * | 12/2003 | Kuntze et al. | 292/262 |
| 7,097,212 | B2 * | 8/2006 | Willats et al. | 292/1 |
| 7,237,276 | B2 | 7/2007 | Longman | |
| 7,299,509 | B1 * | 11/2007 | Neidich | 4/556 |
| 2004/0237184 | A1 * | 12/2004 | Longman | 4/555 |
| 2005/0044620 | A1 | 3/2005 | Metcalf | |
| 2005/0102746 | A1 | 5/2005 | Wright | |
| 2007/0046032 | A1 * | 3/2007 | Moore | 292/36 |
| 2007/0067901 | A1 | 3/2007 | Longman | |
| 2008/0111383 | A1 | 5/2008 | Van Ravenhorst | |
| 2008/0178380 | A1 | 7/2008 | Rydalch | |
| 2008/0276368 | A1 | 11/2008 | Neidich | |

FOREIGN PATENT DOCUMENTS

| | | | |
|---|---|---|---|
| KR | 10-0744579 | B1 | 8/2007 |
| WO | WO 81-02387 | A1 | 9/1981 |
| WO | WO 00-35324 | A1 | 6/2000 |

* cited by examiner

WALK-IN BATHTUB WITH WATER-PROOF DOOR AND SEALING MECHANISM

CROSS REFERENCE TO RELATED APPLICATIONS

This application claims priority from Chinese Application 200820205679.8 filed Dec. 22, 2008, which is hereby incorporated by reference in its entirety.

FIELD OF THE INVENTION

The present invention relates to walk-in bathtubs and more specifically to doors and sealing and latching mechanisms for use with walk-in bathtubs.

BACKGROUND OF THE INVENTION

Walk-in bathtubs include a doorway that permits a user to walk into a bathtub without having to step over the side walls of the bathtub or step down into a sunken tub. Typically, these walk-in bathtubs will include a door within the doorway that swings either into the tub or outward from the tub into an open position to permit entrance and exit from the bathtub. When rotated to a closed position, the doors need some type of sealing mechanism to prevent water from leaking through the doorway when the tub is filled. Inward swinging doors have the advantage of using the hydrostatic pressure of the water to press the door against the doorway to help seal the door. However, the inward swinging doors have the disadvantage of being inconvenient to maneuver around when entering and exiting the bathtub. Outward swinging doors have the advantage of permitting easier entrance and exit to the bathtub, but can be more difficult to seal due to the tendency of the water pressure to press the door away from the closed sealed position.

Various proposals have been suggested for latching and sealing outwardly swinging doors for walk-in bathtubs. However, such designs are not optimal, and can be improved upon. For example, Hayslett, U.S. Pat. No. 3,371,354 shows a walk-in bathtub with an outward swinging door. The door has slots formed in an outward facing surface of its free end that receives lugs that can be extended through the door jam to hold the door closed. This design is relatively complicated and inconvenient to use and install, and furthermore does not include any mechanism for assuring a tight seal between the door and the door jam.

Corlew, U.S. Pat. No. 4,796,312 shows a walk-in bathtub with an outward swinging door that utilizes a simple spring loaded rod that extends through the bottom base of the door into the base of the door jam to retain the door in a closed position. The mechanism of Williams U.S. Pat. No. 4,953,241 is relatively simple to construct and use; however, it does not appear to show sufficient structure for securely sealing the door with the door jam.

Accordingly, there is a need for an improved walk-in bathtub that includes a door that easily and securely closes in a water-tight closed position, and adjusts easily into an open configuration for convenient entrance and exit from the bathtub.

BRIEF SUMMARY OF THE INVENTION

According to one embodiment, the present invention is directed to a walk-in bathtub that has a bathtub frame with a door jam provided within the frame. The door jam has a pin receiving passageway. A door is hingedly attached to the door jam for adjustment between an open position and a closed position. A gasket is disposed between the door and the door jam. A handle is operably connected to latching pin and is movable between a latching position wherein the latching pin is extended and an unlatching position wherein the latching pin is retracted. The latching pin has a tapered face for engagement with the pin receiving passageway as the handle is adjusted towards the latching position with the door near the closed position to draw the door towards the door jam and compress the gasket between the door and the door jam. The door may open outwardly from the bathtub frame. The handle may be pivotally connected to an upper portion of the door and may include the grip portion and a lower portion such that the lower portion is pivotally and slidingly connected to an upper portion of a pivoting bar that is pivotally connected to the door and further wherein a lower portion of the pivoting bar is in operable connection with the latching pin. The tapered face may act as a ramp providing mechanical advantage to help compress the gasket between the door and the door jam. A locking member that can be toggled between a locking position and an unlocking position may be provided to lock the handle in the latching position.

According to another embodiment, the present invention is directed to a door for use on walk-in bathtub having a door jam that includes a latch pin receiver. The door includes a door frame having a top side, a bottom side, a hinged side, and a latching side. The hinge is mounted on the hinged side of the door for hingedly connecting the door frame within the door jam. A pivoting member pivotally attached to the frame has an upper portion and a lower portion. An adjustment member is attached to the door frame for adjusting the top portion of the pivoting member between a latching position and an unlatching position. A latching pin in an operable connection with the lower portion of the pivoting member, and is movable between an extended position when the pivoting member is in the latching position and a retracted position when the pivoting member is in the unlatching position. The latching pin includes a sloped surface for guiding the latching pin into the latch pin receiver within the door jam. The door may include a gasket positioned on the door for sealing engagement with the door jam when the door is in a closed position within the door jam. Such a gasket may be provided within a groove that extends continuously around the door frame proximate to the hinged side, the bottom side, and the latching side, and wherein the gasket includes a tab for interference fit within the groove. The sloped surface of the latching pin may be shaped to provide a mechanical advantage that aids in compressing the gasket between the door and the door jam as the pivoting member is adjusted to latching position. The adjustment member may be a handle that is pivotally connected to the frame proximate to the top side of the frame and the handle may be pivotally and slidingly attached to the top portion of the pivoting member. The door may include a locking member mounted to the door frame that can be toggled between a locking position and an unlocking position such that when the locking member is in the locked position and the pivoting member is in the latching position, the locking member obstructs movement of the handle to prevent movement of the pivoting member out of the latching position. The hinge side, bottom side, and latch side of the frame may be formed into a generally U-shaped portion having a lower portion that defines the bottom side and two upright portions that define the hinged side and the latching side. A support brace may be provided between the two upright portions of the U-shaped portion of the frame, and the pivoting member may be pivotally mounted to the support brace. A cover may be mounted on the brace to provide a waterproof cover for the door. The U-shaped portion of the frame may be made from a single piece of extruded aluminum alloy.

According to one embodiment, the present invention is directed to a bathtub that includes a bathtub frame having side walls and a threshold opening. A door jam is mounted within the threshold. A door is hingedly attached to the door jam with a gasket disposed between the door and door jam. A latching mechanism for latching the door in a closed position includes a movable handle operably connected to a latching pin to selectively extend and retract the latching pin. The latching pin includes a tapered face for engaging a pin receiving aperture formed in the door jam in order to draw the door towards the jam and thereby compress the gasket between the door and the door jam when the door is in a closed position and the handle is moved to adjust the pin into an extended position. According to additional embodiments, the door may be hinged to open outwardly. The handle may include extending projections that act as motion limiters to define the range of motion for the handle. A locking mechanism may be provided to lock the handle in the extended position the lock may operate by restraining the movement of the projections extending from the handle.

According to another embodiment, the present invention is a door for use on a walk-out tub. The door includes a peripheral frame having a top, a bottom, a hinged side and a free side. The door also includes a latching member for selectively extending a latching pin outwardly beyond the free side of the frame and for retracting the pin within the peripheral frame. The latching mechanism has a pivoting member pivotally attached to the frame between an upper portion of the pivoting member and a lower portion of the pivoting member. The latching mechanism also includes an adjustment member for adjusting the top portion of the pivoting member between an open and closed position, and a link between the bottom portion of the pivoting member and the latching pin such that when the top portion is adjusted to an open position the pin is retracted within the frame and when the top portion of the pivoting member is adjusted to the closed position the pin is extended outwardly beyond the free side of the frame.

According to another embodiment, the present invention is a mechanism for sealing a walk-in tub door against a door jam. The mechanism includes a selectively extended pin that has a sloped bearing surface for bearing against a portion of the jam. The sloped bearing surface of the pin is formed such that when part of the pin extends beyond an edge of the door, the tighter the pin draws the door against a gasket disposed between the door and the jam.

DETAILED DESCRIPTION OF THE PREFERRED EMBODIMENT

The attached figures show a preferred embodiment of a walk-in bathtub that includes an outward swinging door. The outward swinging door will pivot between an open configuration that permits a user to easily step into and out of the bathtub and a closed configuration that closes and seals the bathtub so it can be filled with water to permit a user to take a bath. The door includes a latching mechanism for securely latching the door in the closed position.

Figure 1:
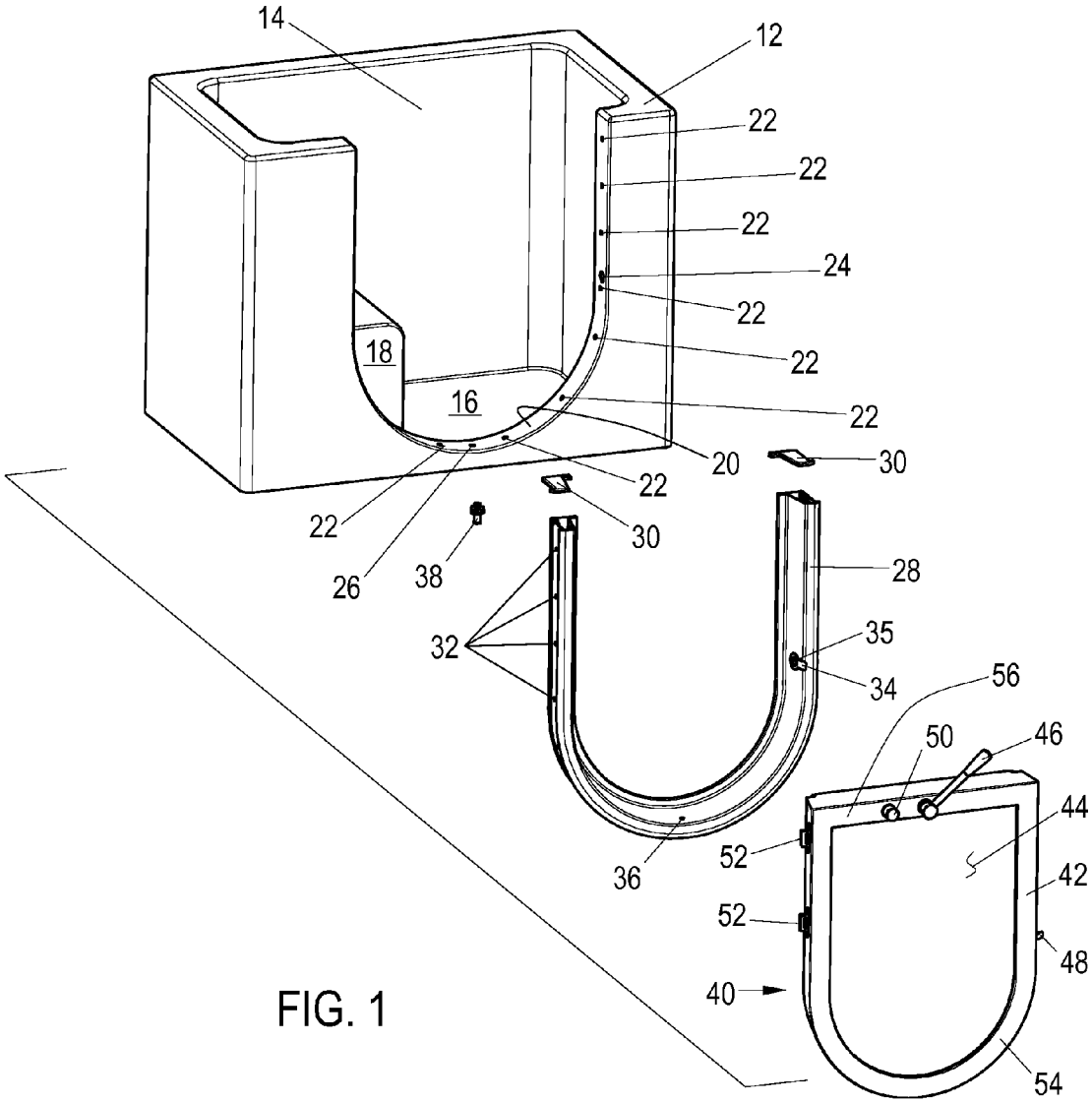
FIG. 1 is an exploded assembly view of a walk-in bathtub having an outward swinging door according to one embodiment of the present invention.
Figure 2:
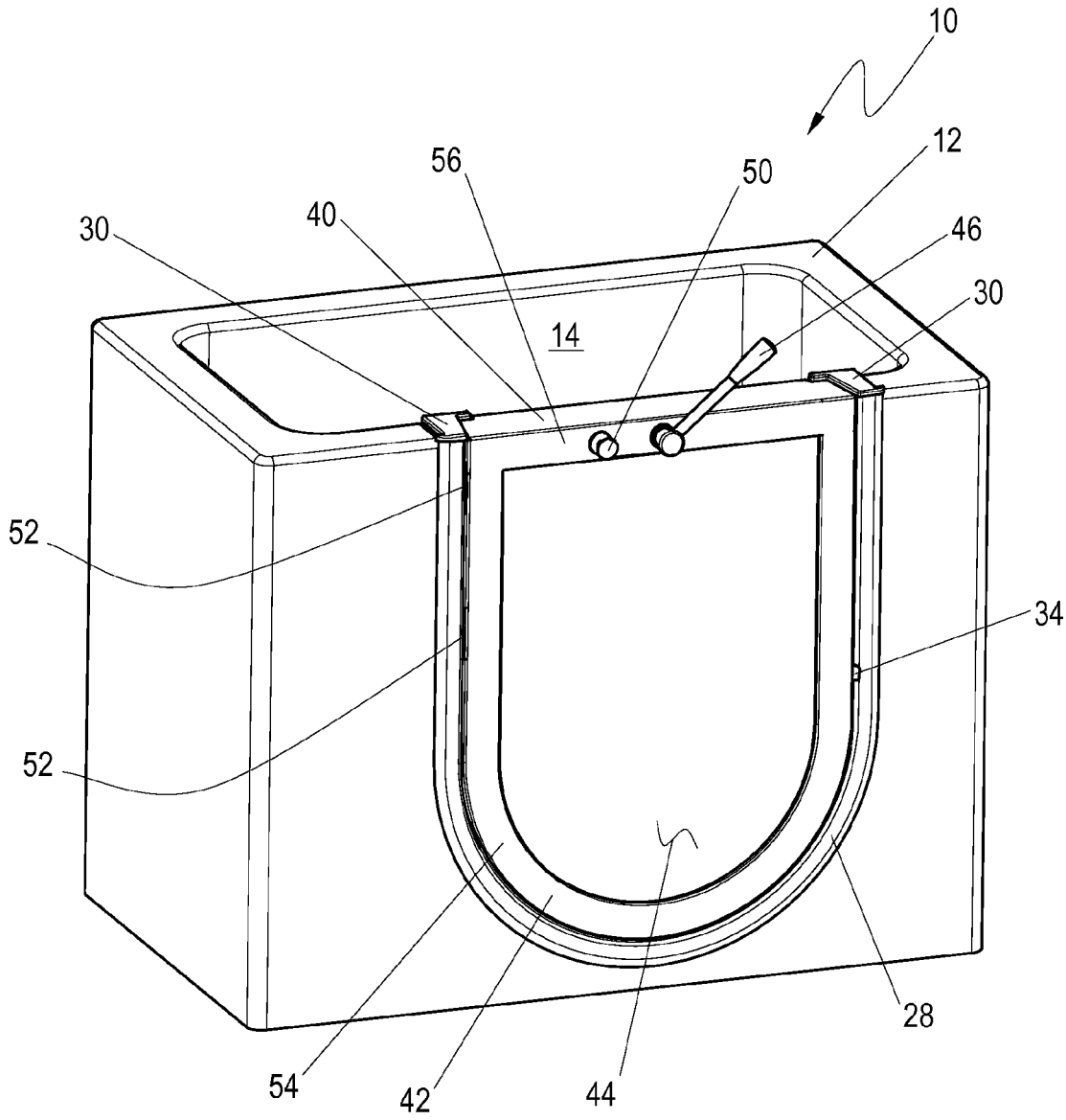
FIG. 2 is an isometric view of a walk-in bathtub according to one embodiment of the present invention, with the door in a closed and latching configuration.

Turning specifically to FIG. 1, an assembly is shown that can be assembled to create the walk-in bathtub 10 shown in FIG. 2. As seen in FIG. 1, the tub includes a tub frame 12 that has generally upright side walls 14 joined at their lower extremes by floor 16. A drain opening (not shown) is provided through the floor 16 to permit water to be drained out of the tub. A seat 18 may be formed within the interior of the tub frame 12 to provide a convenient and easily accessible sitting location within the tub. A threshold 20 is formed within one of the side walls 14, to provide an opening through the frame 12. The threshold 20 may be provided with a series of mounting holes 22 as well as a latch opening 24 and a drainage opening 26. Preferably, the drainage opening 26 will be provided at the lowest extreme of the threshold 20. The tub frame 12 may be formed from any conventional materials using conventional procedures. For example, the tub frame 12 may be formed from acrylic, fiberglass, porcelain, ceramic, stainless steel, aluminum, plastic, or other known materials. Preferably the material will be waterproof, sanitary, resistant to corrosion and mildew, and resistant to cracking or chipping. Those of skill in the art will be aware of numerous materials and methods for creating the tub frame 12.

The assembly shown in FIG. 1 also includes a door jam 28 that is configured to mount within the threshold 20 of the frame 12. According to a preferred embodiment, the door jam 28 is made of extruded aluminum alloy. End caps 30 are provided for covering the ends of the door jam 28. The caps 30 can attach to the door jam 28 by friction fit, or other standard mechanisms. The door jam 28 is provided along an outer surface with mounting holes 32 that correspond and align with the mounting holes 32 provided in the threshold 20. The mounting holes 32 and the door jam 28 may be threaded for receipt of a threaded fastener such as a bolt (not shown). Alternatively, the mounting holes 32 may be provided with threaded nuts. A latch receiver 34 is provided at one side of the door jam 28. This latch receiver 34 will include a latch passageway 35 that aligns with the latch opening 24 provided in the threshold 20 of frame 12. A drainage opening 36 is provided at a lower most portion of an inner surface of the door jam 28, for alignment and communication with the drainage opening 26 provided in threshold 20. A nipple 38 is provided as hardware to be receive through the drainage openings 36 and 26 to connect to a drainage tube (not shown) that leads to a drainage system for draining any water that enters the door jam 20.

With further reference to FIG. 1, a door 40 is provided that includes a door frame 42. A front cover 44 is provided within the door frame 42 and provides a front panel for the door 40. The front cover 44 in a preferred embodiment is made from colored safety glass. Alternatively, the front cover 44 may be an appropriately shaped sheet of plastic, metal, acrylic, or other material. A handle 46 is rotatably mounted to the frame 42 for adjustment of a latching pin 48 through a linkage mechanism (not seen in FIG. 1 because of front cover 44). A push button 50 is also provided on a front side of the door frame 42 for activating and deactivating a lock to hold the handle 46 and latching pin 48 in an extended latching position. The door frame 42 may include a generally U-shaped member 54 formed from a single piece of extruded aluminum alloy and a straight top piece 56 that may be welded or otherwise formed with the U-shaped member 54 to form the door frame 42. Hinges 52 are mounted to the frame 42 by conventional means for connecting the door 40 within the jam 28. Also, as seen in FIG. 3, the door frame 42 may include additional support members (not visible in FIG. 1 because of front cover 44) within its interior.

FIG. 2 shows a bathtub 10 according to one embodiment of the present invention constructed from the components shown in FIG. 1. The bathtub 10 has a door 40 in a closed and latched position within the door jam 28. The door jam 28 is mounted to the frame 12 within the threshold 20 (see FIG. 1). Bolts or other threaded fasteners (not shown) may be used in conventional fashion to attach the door jam 28 to the frame 12. The door jam 28 should be mounted in a water-tight fashion to the frame 12 using conventionally known sealants. The door 40 is mounted to the door jam 28 on hinges 52 (see FIG. 4). Handle 46 is shown in its latching position. It is preferred that in the latching position the handle 46 is rotated away from the seat 18 (see FIG. 1) so that the handle 46 is generally located away from a user when seated within the tub 10.

It should be appreciated that in use, the tub 10 of FIG. 2 will have provided either through the frame 12 or near the frame 12 a faucet for providing water to the interior portion of the tub 10, as well as controls for adjusting the temperature of the water. Additionally, the tub 10 may be used in association with additional structures such as shelves and racks for retaining soap, shampoo, washcloths, and towels. Additional structure may be added to accommodate use of the walk-in tub 10 as part of a shower.

Figure 3:
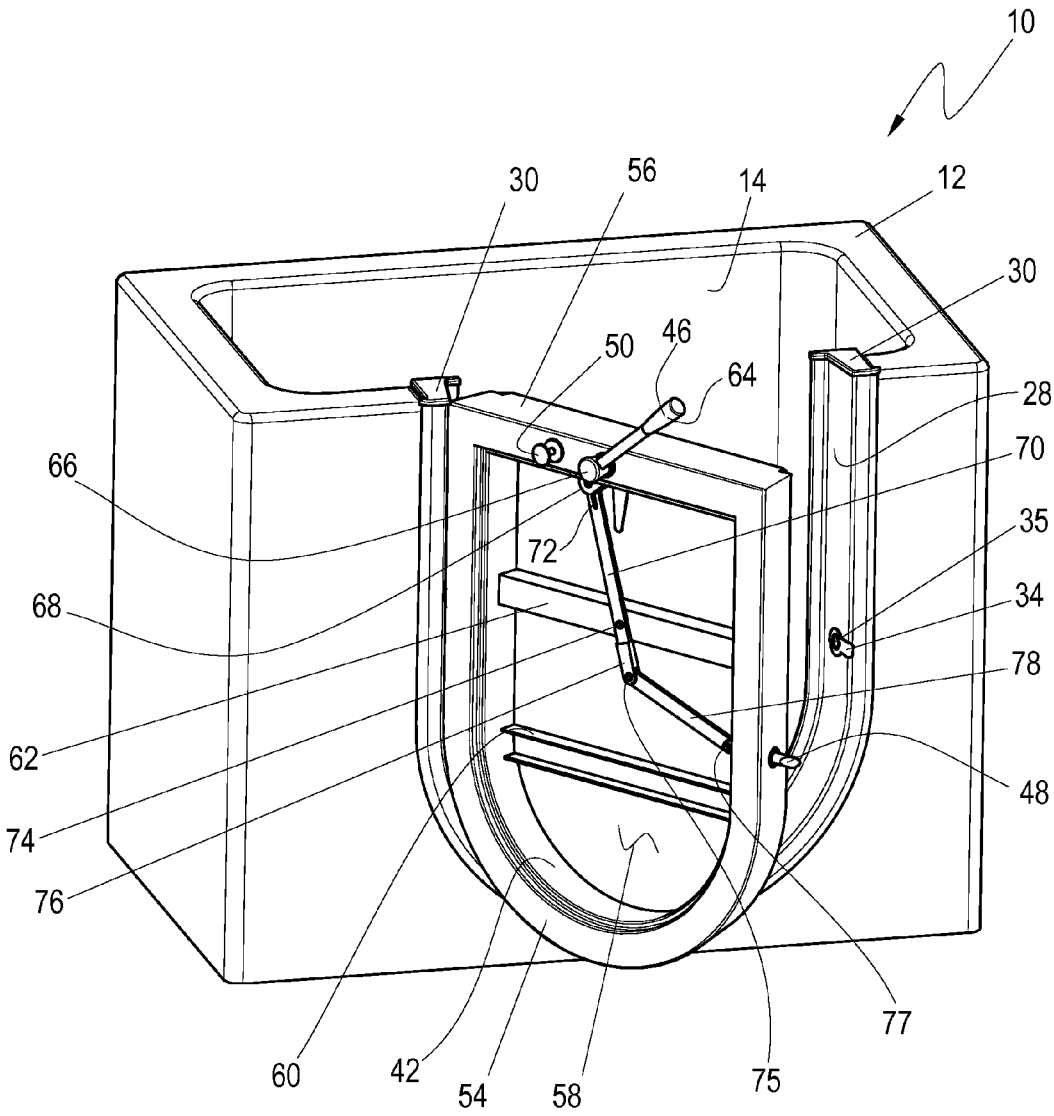
FIG. 3 is an isometric view of the tub of FIG. 2, with the door adjusted to an open position, and with a front cover removed from the door to reveal the latching mechanism.

FIG. 3 shows the walk-in tub 10 of FIG. 2 with its door 40 rotated to an open position and with the front cover 44 removed from the door 40 to reveal the inner workings of the door 40. The handle 46 is again shown in a latching position with the latching pin 48 extended, as in FIG. 2; however it should be appreciated that in order to move from the closed position of FIG. 2 to the open position of FIG. 3, it would have been necessary to move the handle 46 back to a releasing position wherein the latching pin 48 is withdrawn into the door frame 42 (see for example FIG. 4). As seen in FIG. 3, the door 40 is provided with a back (or wet side) cover 58 that is in water tight engagement with the door frame 42. The door frame 42 also includes a lower support brace 60 and an upper support bar 62 spanning between the upright portions of the U-shaped frame member 54. The back cover 58 of the door 40 may be at least partially mounted on the supports 60 and 62.

Several components of the latching mechanism used to latch the door 40 in the closed position of FIG. 2 are revealed in FIG. 3. The handle 46 is rotatably mounted to the top piece 56 of door frame 42 for movement back and forth between the latching position of FIG. 3 and the releasing position of FIG. 4. The handle 46 includes a grip portion 64 provided at an upper free end of the handle 46. A pivot member 66 extends transversely from the handle 46 and is journaled within the top piece 56 of the frame 42. A lower portion 68 of the handle 46 extends below the pivot member 66 on the opposite of the pivot member 66 from the grip 64. Pivoting bar 70 is pivotally attached to upper support bar 62 of the door frame 42 and has an upper portion 72 that is pivotally and slidably joined to the lower portion 68 of handle 46. The pivoting bar 70 pivots around pivot member 74 that connects the pivoting bar 70 to the upper support bar 62. The pivoting bar 70 has a lower portion 76 that extends below the pivot member 74. The lower portion 76 of the pivoting bar 70 is pivotally connected with a first end of linkage member 78 by a pivot member 75. A second end of the linkage member 78 is pivotally attached to the latching pin 48 by pivot member 77.

Figure 4:
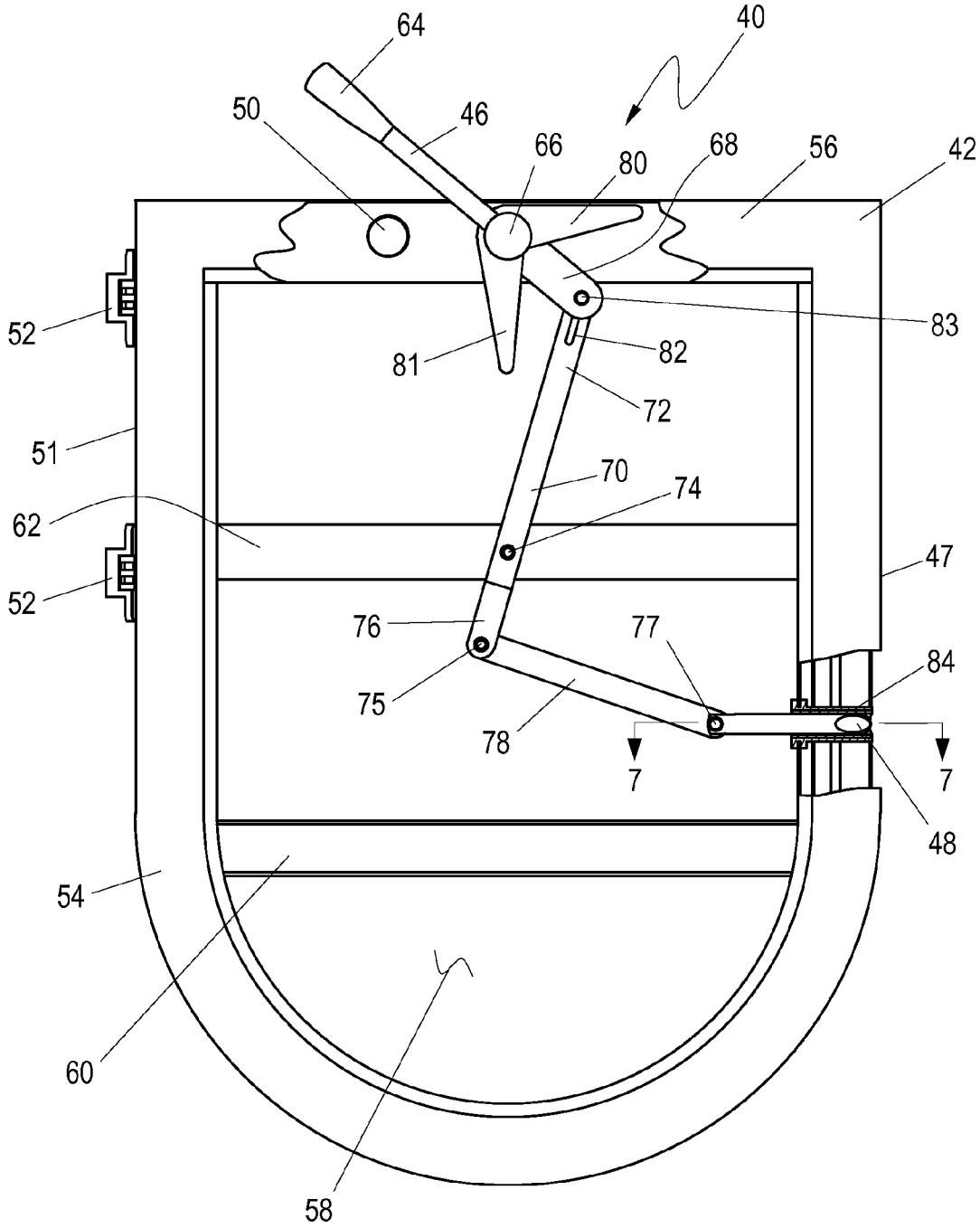
FIG. 4 is a front elevation view with partial cutaways of the door of FIG. 3 with a latching mechanism adjusted to a retracted unlatching configuration.
Figure 5:
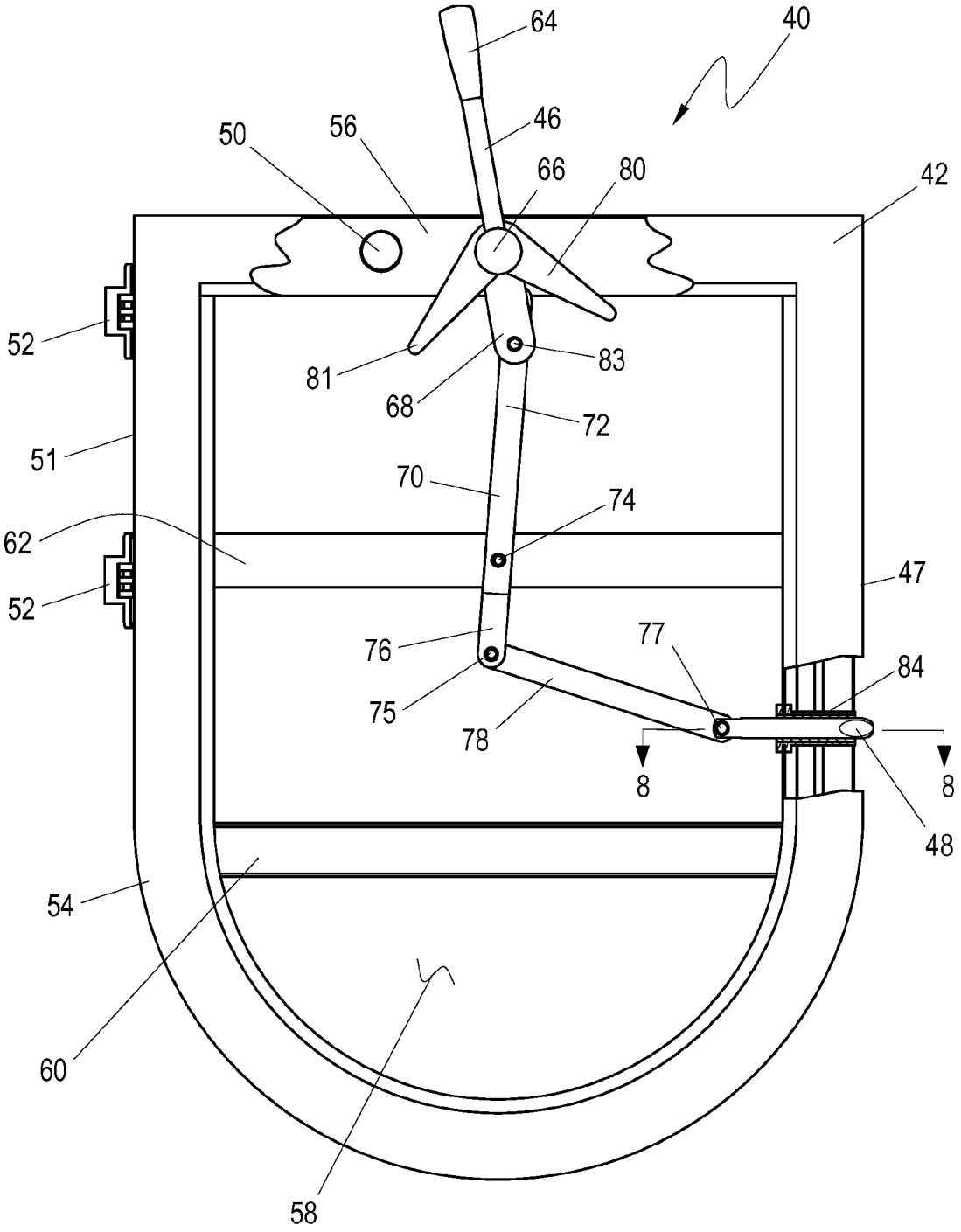
FIG. 5 shows the door of FIG. 4 adjusted part way between the retracted configuration and the extended latching configuration.
Figure 6:
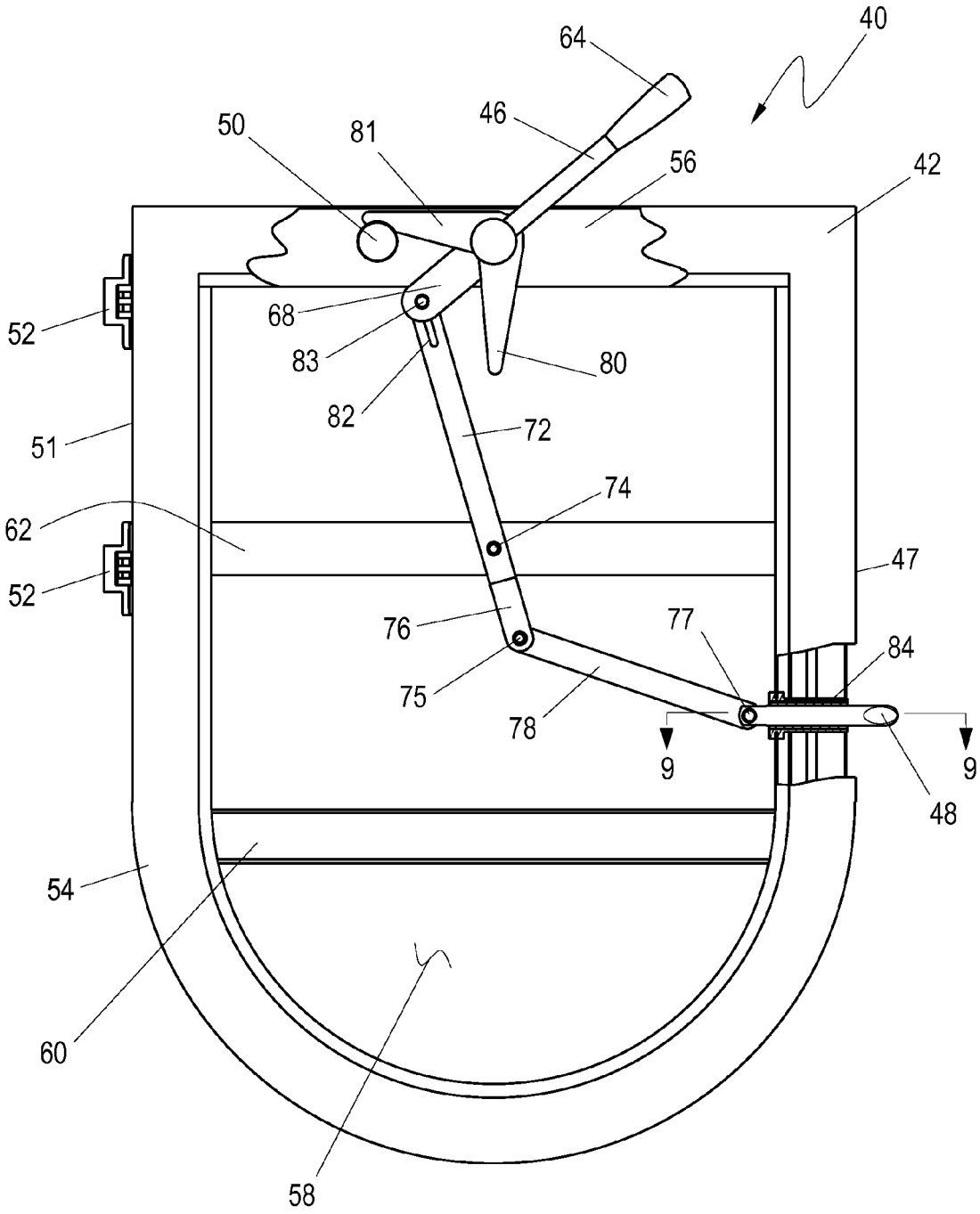
FIG. 6 shows the door of FIG. 4 adjusted to a fully extended latching configuration.

The operation of the latching mechanism as it is adjusted from the unlatched configuration to the latched configuration is shown in FIGS. 4-6. FIG. 4 shows the latching mechanism in an unlatched configuration, FIG. 5 shows the latching mechanism partially rotated between the unlatching configuration and the latching configuration, and FIG. 6 shows the latching mechanism in the latching configuration. Portions of the door frame 42 have been removed in these views to better illustrate the positions of the components.

Turning in detail to FIG. 4, some additional details of the components are shown. Motion limiting flanges 80 and 81 extend generally outwardly from the pivot member 66 of the handle 46. The flange 80 act as stops to limit the range of motion of the handle 46. For example, as seen in FIG. 4, when the handle 46 is rotated towards the unlatched position (in a counterclockwise direction as viewed in FIG. 4) the range of motion is limited by flange 80 coming in contact with an upper inside face of the top piece 56 of door frame 42. The upper portion 72 of pivoting bar 70 is provided with a slot 82 that captures connection member 83 that is attached to the lower portion 68 of handle 46. This arrangement provides for a sliding and pivoting joint between a lower portion 68 of the handle 46 and the upper portion 72 of the pivoting bar 70. A sleeve 84 is provided through the door frame 42 to form a passageway for the latching pin 48. Preferably, the sleeve 84 will be lined with a low friction material, such as nylon. Alternatively, and less preferred, the sleeve could be lubricated. As noted above, the door 40 shown in FIG. 4 has its latching mechanism adjusted to the unlatched configuration. A user can adjust the mechanism to this position by grasping grip 64 of handle 46 and rotating the handle 46 toward the hinge side 51 of the door 40. The flange 80 will act to stop the motion of the handle 46 with the handle 46 in the appropriate position to withdraw latching pin 48 inside an outer periphery of the door frame 42. While it is preferred to withdraw the latching pin 48 completely within the frame 42 in the unlatched configuration, all that is necessary is that the pin 48 be withdrawn sufficiently that the latch pin 48 does not interfere with the door jam 28. With the latching pin 48 withdrawn into the frame 42 as shown in FIG. 4, the door 40 can be rotated about hinges 52 between an open and closed position without the latching pin 48 restraining the movement.

FIG. 5 shows the door of FIG. 4 where the handle 46 has been partially rotated towards the latching position. It can be seen by comparing FIG. 4 and FIG. 5 that in FIG. 5 the lower portion 68 of the handle 46 has been moved towards the hinge side 52 of the frame 42, correspondingly causing the pivoting bar 70 to pivot about pivot member 74, which in turn causes the lower portion 76 of the pivoting bar 70 to drive linkage member 78 generally towards the latch side 47 of the door 40

(to the right as seen in FIG. 5), which in turn extends latching pin 48 at least partly through the sleeve 84.

FIG. 6 shows the latching mechanism adjusted into a latching configuration. As seen in FIG. 6, the grip portion 64 of the handle 46 has been rotated towards the latch side 47 of door 40. Motion of the handle 46 in that direction is limited by flange 81 abutting against the inside face of the upper frame piece 56 of door frame 42. As compared to FIG. 5, in FIG. 6 the lower portion 68 of the handle 46 has moved towards the hinge side 51 of the door 40, which in turn has pivoted pivoting bar 72 about pivot member 74 to rotate the lower portion 76 of the pivoting bar towards the latch side 47 of the door 42. This movement in turn causes linking member 78 to be driven towards the latching pin 48 to push the latching pin 48 through the sleeve 84 to extend outwardly beyond the frame 42.

Figure 7:
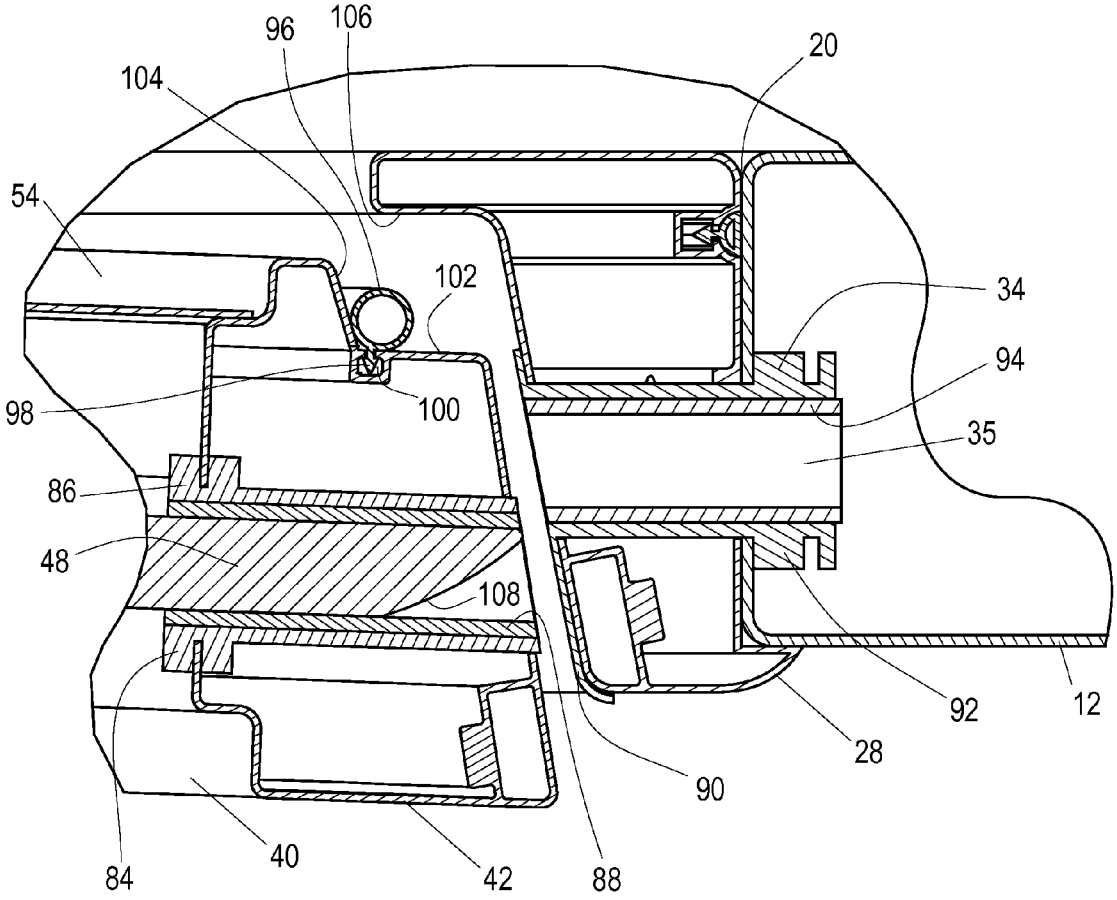
FIG. 7 is a partial cross sectional view of the latching pin and door jam from FIG. 4.
Figure 8:
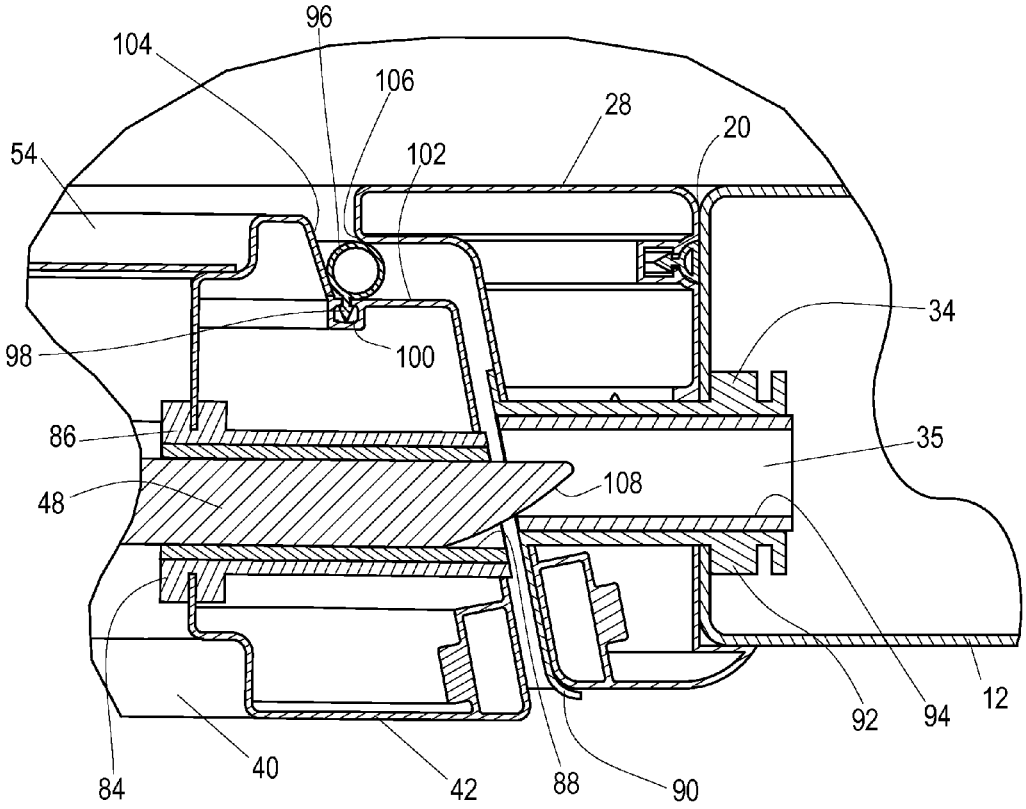
FIG. 8 is a partial cross sectional view of the latching pin and door jam of FIG. 5.
Figure 9:
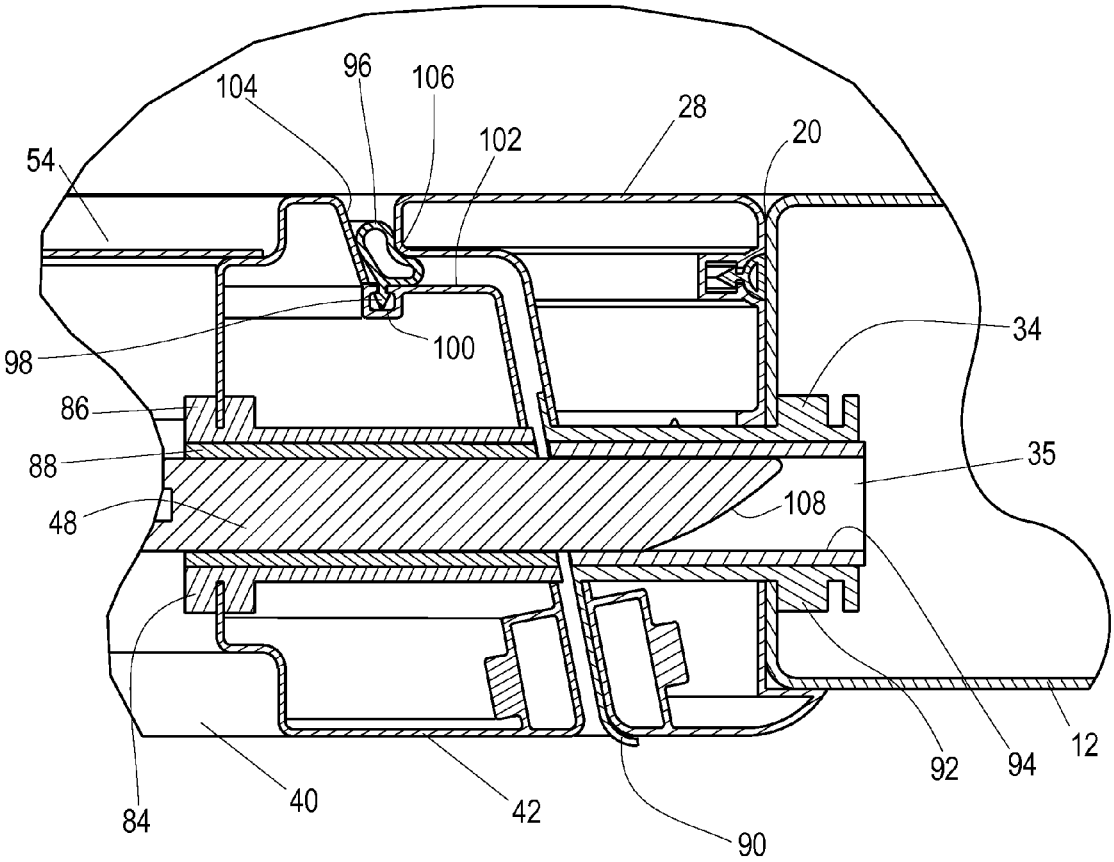
FIG. 9 is a partial cross sectional view of the latching pin and door jam of FIG. 6.

FIGS. 7, 8 and 9 illustrate a cross sectional view showing the latching pin 48 as it engages the door jam 28 to seal the door 40 with the door jam 28. FIG. 7 shows the latching pin 48 withdrawn into sleeve 84 within the door frame 42. As seen in FIG. 7, the sleeve 84 includes an outer support section 86 that may be formed from a hard durable material that can be used to mount the sleeve 84 to the door frame 42. The sleeve 84 preferably includes a low friction liner 88 for sliding engagement with the latching pin 48. The latch receiver 34 includes a strike plate 90 that covers a portion of the door jam 28 that would otherwise be subject to contact by the latching pin 48 when the patching pin is extended sufficiently to contact the door jam 28. The strike plate 90 may be formed integrally with a sleeve support 92 that defines a passageway 35 through the door jam 28. A low friction sleeve liner 94 may be provided within the sleeve support 92 to reduce friction as the latching pin 48 enters the latch pin passage 35 formed in the door jam 28. Those of skill in the art will be aware of suitable materials for forming the sleeve support 86 and 92 as well as the low friction sleeve liners 88 and 94. In a preferred embodiment, the sleeve supports 86 and 92 are formed from stainless steel and the low friction sleeve liners 88 and 94 are formed from nylon.

A gasket 96 is provided on the door 40. The gasket 96 is formed integrally with an attachment tab 98 that can be interference fit into a groove 100 formed on an inner surface of the door 40. Preferably, the groove 100 is provided generally at a junction between an inward face 102 of the door 40 and a transverse face 104 of the door 40. The groove 100 preferably extends continuously around the door near the outer edges of the door. Preferably the transverse face 104 will face generally towards the door jam 28 around the entire periphery of the U-shaped frame member 54. The gasket 96 should be in alignment for contact with a lip 106 formed on an inside edge of the door jam 28.

The latching pin 48 includes a tapered contoured face 108. The contoured face 108 is important for providing a mechanical advantage in closing the door 40 against the door jam 28 to fully compress gasket 96 and guide the latching pin 48 fully into the passage 35 formed within sleeve support 92. The contoured face 108 should therefore be generally sloped to have a ramp configuration. It may be preferable to have the contoured face 108 be slightly concave, as shown in FIGS. 7-9. The contoured face 108 should be shaped so as to guide the latching pin 48 into a passageway 35. Additionally, the contoured face 108 should be durable and low friction in order to easily slide across a low friction sleeve liner 94. In a preferred embodiment, the latching pin 48 is formed from stainless steel that is buffed to create a smooth low friction surface.

FIG. 8 shows a partial cross section view of the door frame 40, the latching member 48 and the door jam 28, as the latching member is beginning to engage the latch receiver 34. FIG. 8 corresponds with the latching mechanism being part way between the unlatched position and the latched position as shown in FIG. 5. As seen in FIG. 8, as the door 40 is brought close to the closed position, the gasket 96 will contact the lip 106 of the door jam 28. By adjusting the handle 46 towards the latching position, the latching pin 48 will be driven towards the latch receiver 34, causing the contoured face 108 to contact and ride along an edge of the low friction sleeve liner 94 provided within the latch receiver 34. The contoured face 108 provides a mechanical advantage that will help drive the door 40 inward to compress the gasket 96 tightly between the lip 106 of the door jam 28 and the faces 102 and 104 of the door 40.

FIG. 9 shows the mechanism of FIGS. 7 and 8 wherein the latching pin 48 has been fully adjusted into the latching position. As seen in FIG. 9, in this configuration the latching pin 48 is securely within sleeve liner 94 to fully compress gasket 96 and form a water tight barrier to prevent water from leaking into the space between the door 40 and door jam 28.

By utilizing the contoured face 108 to provide a mechanical advantage in compressing the gasket 96, a thicker gasket than could otherwise be used is possible. This creates a more secure and water tight seal. According to a preferred embodiment a gasket having a thickness of about two millimeters may be utilized. A tab 98 formed on the gasket 96 includes ridges that retain the tab 98 within the groove 100 formed in the door 40. Preferably, the tab is shaped so that it can be pressed into the groove 100, but will provide additional resistance against being pulled back out through the groove. The tab therefore provides a convenient mechanism for securely fastening the gasket 96 to the door 40.

Figure 10:
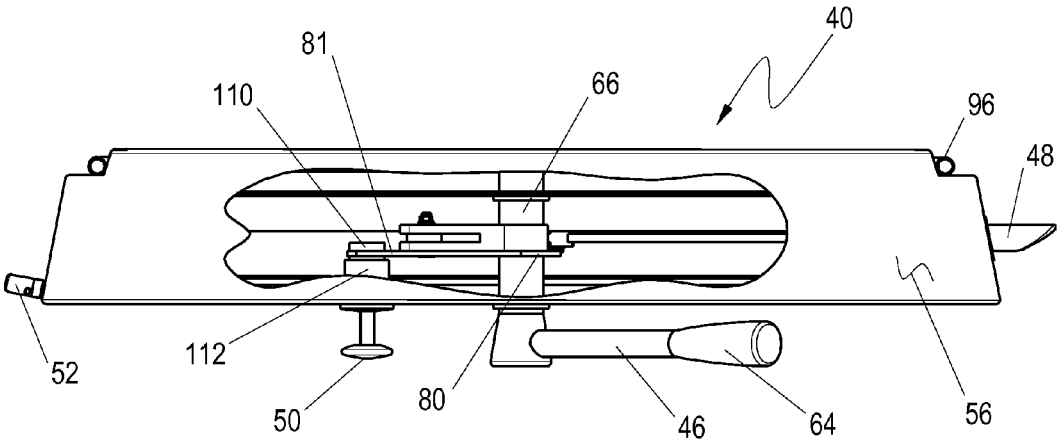
FIG. 10 is a partial cutaway top plan view of a door according to one embodiment of the present invention with the latching mechanism adjusted to an extended latching configuration, and the locking mechanism in a locking position.
Figure 11:
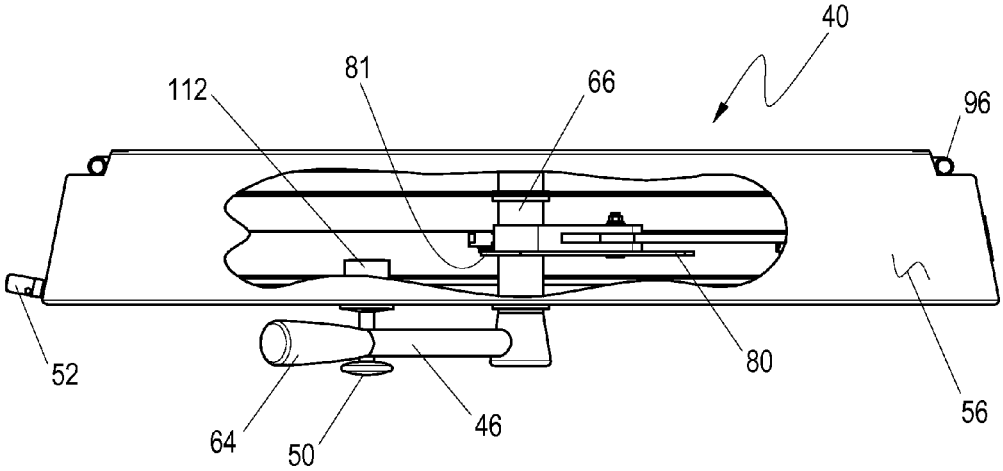
FIG. 11 shows the door of FIG. 10 with the locking mechanism in an unlocked position and the latching mechanism adjusted to a retracted unlatched configuration.

FIGS. 10 and 11 show a top view of a door 40 according to the preferred embodiment of the present invention with a portion of the top piece 56 of the door frame 42 removed to illustrate a locking feature of the present invention. FIG. 10 shows a door 40 with its latching mechanism adjusted to a latching position with the handle 46 moved all the way to the latching position, and with the latching pin 48 fully extended from the side of the door 40. The locking mechanism includes push button 50 that can be pressed to extend locking member 110 from locking base 112. In this extended locking position shown in FIG. 10, the locking member 110 is retained in the extended position, which captures the motion limiting flange 81 between the locking member 110 and the lower face of the top piece 56 of the door frame 42. With the locking member adjusted to the extended locking position, the latching mechanism is therefore prevented from moving out of the latched position. The handle 46 cannot be accidentally rotated back towards the unlatched position, because flange 81 will not move past locking member 110. This is an important safety feature that can avoid accidentally unlatching the door while the tub is filled with water, which could result in the pressure of the water forcing the door 40 open, causing an unwanted release of water out of the tub 10. A locking member 110 toggles between the extended locking position of FIG. 10 and a withdrawn unlocked position of FIG. 11 by pushing button 50. FIG. 11 shows the locking mechanism toggled to an unlocked position with the locking member 110 withdrawn into locking base 112. In this unlocked position, the latching mechanism can be freely adjusted between the latched and unlatched configurations. Those of ordinary skill in the art will be aware of conventional push-button mechanisms for toggling the locking member between the locked and unlocked positions. FIG. 11 shows the latching mechanism adjusted to an unlatched configuration with the handle 46 rotated to the unlatched position and the latching member 48 withdrawn into the door 40.

To use the walk-in bathtub 10 as described above and shown in the attached figures, a user would open the door 40 and adjust the latching mechanism to the unlatched position by grasping grip 64 and rotating the handle 46 towards the hinge side 51 of door 40. The user could then easily step into the tub 10, sit down on seat 18, and close the door 40 by grasping grip 64 and pulling the door 40 generally towards the closed position. When the gasket 96 on the door 40 comes into contact with the lip 106 of the door jam 28 the user will push the grip 64 towards the latch side 41 of the door 40 to move the handle 46 towards the latching position. As the handle 46 rotates towards the latching position, the latching pin 48 is driven outwardly through the door frame 42 into contact with the latch pin receiver 34 in the door jam 28. As the handle 46 continues to rotate towards the latching position, the contoured face 108 of the latching pin 48 rides along the low friction sleeve liner 94 provided on the latch receiver 34 to help guide the latching pin 48 into the fully extended position within passage 35 in order to fully compress gasket 96 between the faces 102 and 104 of the door 40 and the lip 106 of the door jam 28. A user may then lock the latching mechanism in the latching position by pressing push button 50 and toggling locking member 110 into the extended locked position. The user may then fill the tub 10 with water of a desired temperature in order to bathe. When the bath is completed, the user should completely drain the water from the tub so that the water level is below the lowest portion of the door jam 28. At that point, the user can exit the bathtub by again pressing push button 50 to toggle the locking member 112 back into the retracted unlocked position. The user can then grasp grip 64 on handle 46 and rotate the handle 46 back towards the unlocked position to retract latching pin 48 out of the passageway 35. The low friction sleeve 94 helps the pin 48 slide back towards the retracted unlatched position without significant friction resistance. Once the latching pin 48 is retracted sufficiently to be free from the latch receiver 34, the door 40 can be easily rotated to the open position to permit a user to step out of the tub. In the unlikely event that some water has leaked past the seal formed by the gasket 96, the shape of the door jam 48 will cause that water to run towards and into nipple 38 provided through drainage opening 36 in order to prevent water from escaping outside the confines of the tub 10.

Presently preferred embodiments of the present invention have been described with a degree of particularity. The previous description is of preferred examples for implementing the invention, and the scope of the invention should not necessarily be limited by this description. The scope of the present invention is defined by the scope of the following claims. For example, the presently preferred material for forming many of the components of the latching mechanism, such as the handle 46, the pivoting member 70, the linkage member 78, and the latching pin 48 is stainless steel. However, those of ordinary skill in the art will be aware of other suitable materials for forming these components, and the invention should not be limited to the preferred materials, except when specified in the claims. Furthermore, while the present invention is thought to be of primary utility with walk-in bathtub doors that swing outward, it is contemplated that many of the advantages could be realized in walk-in tubs that include inward swinging doors.

What is claimed is:

1. A walk-in bathtub comprising:

a bathtub frame defining a threshold and an interior bathing area;

a door jamb within the threshold, the door jamb having a pin receiving passageway, the door jamb including an outward facing surface facing away from the bathing area;

a door hingedly attached to the door jamb for rotation around a hinge between an open position and a closed position, the door including an inward facing surface;

a gasket disposed between the inward facing surface of the door and a portion of the outward facing surface of the door jamb;

a movable handle adjustable between a latching position and an unlatching position and operably connected to a latching pin to selectively extend the latching pin when in the latching position and retract the latching pin when in the unlatching position, wherein the handle is pivotally connected to an upper portion of the door to pivot about a first pivot member, the handle having a grip portion located generally above the first pivot member and a lower portion located generally below the first pivot member;

a pivoting bar pivotally connected at a central portion of the pivoting bar to the door to pivot about a second pivot member, the pivoting bar having a first portion generally above the central portion with a slot to pivotally and slidingly connect the pivoting bar to the lower portion of the handle, and having a second portion on an opposite side of the second pivot member from the first portion operably connected to the latching pin; and wherein the latching pin has a tapered face that engages the pin receiving passageway as the handle is adjusted towards the latching position when the door is near the closed position to draw the door towards the door jamb and compress the gasket between the inward facing surface of the door and the outward facing surface of the door jamb.

2. The walk-in bathtub according to claim 1, wherein the door rotates open outwardly from the bathtub frame around the door jamb.

3. The walk-in bathtub according to claim 1, wherein the second portion of the pivoting bar is operably connected to the latching pin by a linkage bar that is pivotally connected to the second portion of the pivoting bar and the latching pin.

4. The walk-in bathtub according to claim 1, wherein the tapered face acts as a ramp that provides a mechanical advantage to help compress the gasket between the door and the door jamb.

5. The walk-in bathtub according to claim 1, further comprising a locking member for locking the handle in the latching position when the door is in the closed position.

6. The walk-in bathtub according to claim 1, wherein the handle further comprises flanges that limit a range of motion for the handle between the latching position and the unlatching position.

7. The walk-in bathtub according to claim 6, further comprising a locking member on the door that can be toggled between a locking position and an unlocking position, and further wherein when the locking member is in the locked position with the handle in the latching position and the door in the closed position, the locking member obstructs movement of the handle out of the latching position.

8. A door for use on a walk-in bathtub having a door jamb that includes a latch pin receiver, the door comprising:

a door frame having a top side, a bottom side, a hinged side, and a latching side, the door frame including two spaced apart upright portions and at least first and second cross members spanning between the upright portions, the first cross member being located below the second cross member;

a hinge mounted on the hinged side of the door frame for hingedly connecting the door frame within the door jamb;

a movable handle adjustable between a latching position and an unlatching position and operably connected to a latching pin to selectively extend the latching pin when in the latching position and retract the latching pin when in the unlatching position, wherein the handle is pivotally connected to the second cross member to pivot about a first pivot member, the handle having a grip portion located generally above the first pivot member and a lower portion located generally below the first pivot member;

a pivoting bar pivotally connected at a central potion of the pivoting bar to the first cross member to pivot about a second pivot member, the pivoting bar having a first portion generally above the central portion with a slot to pivotally and slidingly connect the pivoting bar to the lower portion of the handle, and having a second portion on an opposite side of the second pivot member from the first portion operably connected to the latching pin; and wherein the latching pin is movable between an extended position wherein the latching pin extends outward beyond the latching side of the door frame when the handle is in the latching position and a retracted position wherein the latching pin is withdrawn at least partially into the door frame when the handle is in the unlatching position.

9. The door according to claim 8, further comprising a gasket positioned on the door for sealing engagement with the door jamb when the door is in a dosed position within the door jamb.

10. The door according to claim 9, wherein the door is provided with a groove that extends continuously around the door frame proximate to the hinged side, the bottom side and the latching side, and wherein the gasket includes a tab for interference fit within the groove to retain the gasket on the door.

11. The door according to claim 9, wherein the sloped surface of the latching pin is shaped to provide a mechanical advantage that aids in compressing the gasket between the door and the door jamb as the pivoting member is adjusted to the latching position.

12. The door according to claim 8, wherein the hinge side, bottom side, and latch side of the frame are formed into a generally U-shaped portion having a lower portion that defines the bottom side and two upright portions that define the hinged side and the latching side.

13. The door according to claim 8, wherein a cover is mounted on at least one of the cross members to provide a waterproof cover on an inside surface of the frame.

14. The door according to claim 12, wherein the U-shaped portion of the frame is made from a single piece of extruded aluminum alloy.

15. The door according to claim 8, wherein a linkage bar is provided between the lower portion of the pivoting bar and the latching pin.

16. The door according to claim 15, wherein the linkage bar is pivotally connected to the second portion of the pivoting bar and pivotally connected to the latching pin.

17. The door according to claim 8, further comprising a locking member mounted to the door frame that can be toggled between a locking position and an unlocking position, and further wherein when the locking member is in the locked position with the voting member in the latching position, the locking member obstructs movement of the handle to prevent movement of the pivoting member out of the latching position.

18. The door according to claim 8, wherein the latching pin includes a sloped surface for guiding the latching pin into the latch pin receiver.

* * * * *

UNITED STATES PATENT AND TRADEMARK OFFICE

CERTIFICATE OF CORRECTION

PATENT NO. : 8,375,478 B2
APPLICATION NO. : 12/409966
DATED : February 19, 2013
INVENTOR(S) : Zhi Gang Luo It is certified that error appears in the above-identified patent and that said Letters Patent is hereby corrected as shown below:

Col. 12, Claim 17, Line 30:
DELETE after with the "voting"
ADD after with the --pivoting--

Signed and Sealed this
Second Day of April, 2013

Teresa Stanek Rea
*Acting Director of the United States Patent and Trademark Office*